US008763333B1

(12) United States Patent
Finfrock et al.

(10) Patent No.: US 8,763,333 B1
(45) Date of Patent: Jul. 1, 2014

(54) METHOD OF MAKING A DUAL PANEL COMPOSITE TRUSS

(71) Applicants: Robert D Finfrock, Orlando, FL (US); Allen R Finfrock, Maitland, FL (US); Daniel Finfrock, Orlando, FL (US); Donald Booker, Fernandina Beach, FL (US)

(72) Inventors: Robert D Finfrock, Orlando, FL (US); Allen R Finfrock, Maitland, FL (US); Daniel Finfrock, Orlando, FL (US); Donald Booker, Fernandina Beach, FL (US)

(73) Assignee: Finfrock Industries, Inc., Apopka, FL (US)

( * ) Notice: Subject to any disclaimer, the term of this patent is extended or adjusted under 35 U.S.C. 154(b) by 0 days.

(21) Appl. No.: 13/957,960

(22) Filed: Aug. 2, 2013

Related U.S. Application Data

(63) Continuation of application No. 13/826,425, filed on Mar. 14, 2013, now Pat. No. 8,667,755.

(51) Int. Cl.
*E04B 2/00* (2006.01)

(52) U.S. Cl.
USPC ..... 52/431; 52/690; 52/790.1

(58) Field of Classification Search
USPC ..... 52/414, 426, 431–433, 783.1, 790.1, 52/690, 693, 479, 442, 565, 378, 428
See application file for complete search history.

(56) References Cited

U.S. PATENT DOCUMENTS

| | | | | |
|---|---|---|---|---|
| 1,573,502 | A * | 2/1926 | Peters | 156/42 |
| 4,125,981 | A * | 11/1978 | MacLeod et al. | 52/309.12 |
| 4,921,387 | A * | 5/1990 | Bennington | 414/779 |
| 5,440,845 | A * | 8/1995 | Tadros et al. | 52/309.12 |
| 7,891,150 | B2 | 2/2011 | Finfrock et al. | |
| 2010/0152312 | A1 * | 6/2010 | Burdeniuc et al. | 521/118 |

* cited by examiner

*Primary Examiner* — Jeanette E Chapman
*Assistant Examiner* — Daniel Kenny
(74) *Attorney, Agent, or Firm* — William M. Hobby, III

(57) ABSTRACT

This invention relates to a method of making a dual panel composite truss having a pair of spaced apart prestressed concrete panels. The process includes assembling a truss frame, which includes connecting a plurality of steel posts and bent rod truss members and reinforcing rods and lifting and placing the assembled truss frame in a panel form for pouring a first prestressed concrete panel on one side of the truss frame. The truss frame with the first concrete panel is then stripped, lifted and placed on a turntable and turned to place the other side of the truss frame in the panel form for pouring a second concrete panel, to form a dual panel composite truss having parallel spaced prestressed concrete panels.

13 Claims, 5 Drawing Sheets

METHOD OF MAKING A DUAL PANEL COMPOSITE TRUSS

This application is a continuation-in-part of U.S. patent application Ser. No. 13/826,425 filed Mar. 14, 2013 for a Dual Panel Composite Truss Apparatus.

FIELD OF THE INVENTION

This invention relates to a dual panel composite truss having a pair of spaced apart prestressed concrete panels and especially to a process for making a composite truss having a pair of spaced apart concrete panels.

BACKGROUND OF THE INVENTION

Prefabricated double wall concrete components have been used in the past to construct building walls. Such wall members may include a plurality of welded wire spacing frames to retain the slabs of the wall member in a spaced apart configuration. Typically, the welded wire spacing frames provide limited structural reinforcement of the wall member. It has been proposed to use such prefabricated wall members as structural flooring and/or roofing members. However, a dual slab member designed as a wall may not be readily adaptable to a floor or roofing application due to different loading forces on the member. For example, a wall member used in a floor application may have a limited span distance due to the minimum structural capacity provided by the welded wire spacing frames. More robust welded steel trusses having upper and lower longitudinal portions embedded in respective upper and lower slabs have been proposed as a framing structure for a composite truss that can span up to 60 feet and greater. However, welding and/or other structural attachment techniques used to manufacture such framing structures significantly adds to the cost and time needed to manufacture the trusses and thereby increases the cost of the composite truss.

In our prior U.S. patent application Ser. No. 13/826,425 for a Dual Panel Composite Truss Apparatus, a dual panel truss has a pair of spaced apart prestressed concrete panels having a versatile and adaptive structurally supporting end bearing truss on the ends thereof. The end bearing truss incorporates a versatile and adaptive structural support on each end of the composite truss. The end bearing truss is formed as an integral part of the composite truss for supporting the ends of the composite truss when the composite truss is used for the floors and ceiling of a building. The end bearing truss advantageously forms each end of each concrete panel form for the concrete pour when making each concrete panel. This prior patent application is an improvement of prior U.S. Pat. No. 7,891,150 for a Composite Truss by Robert D. Finfrock and Allen R. Finfrock. In this prior patent, a composite truss has a pair of spaced apart prestressed concrete panels and a plurality of substantially vertical members spanning between the pair of spaced apart concrete panels, one end portion of each vertical member being embedded in one of the spaced apart concrete panels and the opposite end being imbedded in the other concrete panel. The truss includes a diagonal member spanning between the one end of a vertical member and the other end of an adjacent vertical member. Each end of the diagonal member non-structurally engages an end of a vertical member. Each diagonal member also has a length thereof embedded in the concrete in each spaced apart concrete panel. Each end of the composite truss has a prefabricated concrete end bearing beam for supporting the end of the composite truss.

The present invention relates to a method of making a dual panel composite truss having a pair of spaced apart prestressed concrete panels. The process includes assembling the truss frame, which includes interconnecting and mounting a plurality of steel posts and connecting truss members and reinforcing rods, and positioning a truss frame in a panel form having prestressed strands therein for pouring a first prestressed concrete panel on one side of the truss frame. The truss frame with the first concrete panel is then stripped from the form, lifted and placed on a turning table and turned to position the other side of the truss frame in the panel form for pouring concrete into the panel form for pouring the second prestressed concrete panel, which when cured, is spaced from the first panel by the truss frame forming a composite.

SUMMARY OF THE INVENTION

This invention relates to a method of making a dual panel composite truss having a pair of spaced apart prestressed concrete panels for use in a building floor and ceiling. A truss frame has a pair of spaced apart prestressed concrete panels spaced by a plurality of frame members. The process of forming a dual panel composite truss includes assembling a truss frame on a fixture table having a plurality of truss frame clamping fixtures laser aligned thereon. A plurality of posts of predetermined length are formed along with a plurality of bent rod truss members each having two end portions. Each bent rod truss member is attached to one end of one post and to the other end of an adjacent post. A plurality of reinforcing rods (rebar) are attached to the bent rod truss members. The panel form has a plurality of pre-stressed strands tensioned between the ends of stressing headers positioned at each end of the concrete panel form. The assembled truss frame is then placed in the concrete panel form with one side resting on the base of the panel form. The reinforcing rods attached to the assembled truss frame placed in the form are then attached to the pre-stressed strands in the form. A steel end plate is attached to each end of the assembled truss frame in the concrete form to form part of the truss frame and to define each end of the concrete panel concrete pour. Concrete is poured in the panel form portion between the steel end plates and cured to form the first prestressed concrete panel on one side of the assembled truss frame. The assembled truss frame having the first concrete panel formed on one side thereof is then stripped from the form, lifted and moved onto a vacuum turn table where it is turned to position the other side of the assembled truss frame in the panel form. Concrete is then poured into the panel form and cured to form a second concrete panel on the other side of the assembled truss frame, spaced from the first concrete panel by the center portion of the assembled truss frame to thereby form a dual panel composite truss.

In more detail, the process of forming a dual panel composite truss starts with assembling a truss frame by bending a plurality of bars into bent truss members and making a plurality of posts of predetermined length, each post having a pair of slots in each end thereof and the making of a plurality of standoff members, each shaped to be attached to one end of each post. A plurality of clamping fixtures are laser aligned on a truss frame fixture or assembly table and a post having a bent rod truss member attached thereto is attached in each fixture. A bent rod truss member has one end attached to one end of one of the posts which is then inserted into a clamping fixture on a fixture table and the other end attached to the other end of an adjacent post. One standoff member is attached to each end of each post. A plurality of reinforcing rods are attached to each bent rod truss member to form an assembled truss frame.

A plurality of prestress strands are tensioned in a concrete panel form and held under tension between stressing headers at each end of the concrete panel form. The assembled truss frame is then placed in the concrete panel form with one side resting on the base of the panel form. The plurality of reinforcing rods or rebar attached to the truss frame are then attached to the pre-stressed strands in the form. A steel end plate is attached to each end of the assembled truss frame in the concrete form to form part of the truss frame and to define each end of the concrete panel concrete pour. Concrete is poured in the panel form portion between the steel end plates and cured to form the first prestressed concrete panel on one side of the assembled truss frame. The assembled truss frame having the first concrete panel formed on one side thereof is then stripped from the form, lifted and placed onto a vacuum turn table where it is turned to position the other side of the assembled truss frame in the panel form. Concrete is then poured into the panel form and cured to form a second concrete panel on the other side of the assembled truss frame, spaced from the first concrete panel by the center portion of the assembled truss frame to thereby form a dual panel composite truss.

BRIEF DESCRIPTION OF THE DRAWINGS

The accompanying drawings, which are included to provide further understanding of the invention are incorporated in and constitute a part of the specification, and illustrate an embodiment of the invention and together with the description serve to explain the principles of the invention.

In the drawings.

DETAILED DESCRIPTION OF AN EXEMPLARY EMBODIMENT

Figure 1:
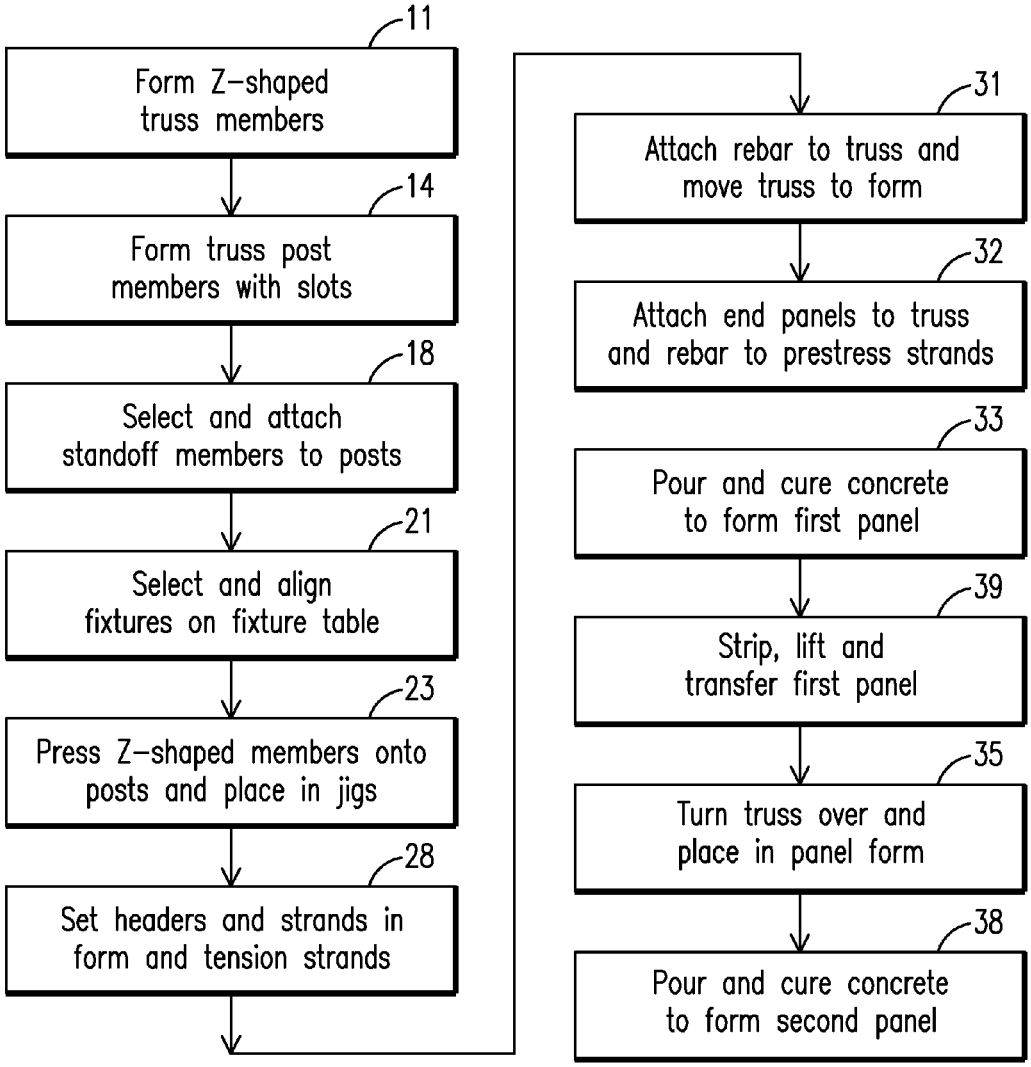
FIG. 1 is a flow diagram of the process of the present invention.
Figure 10:
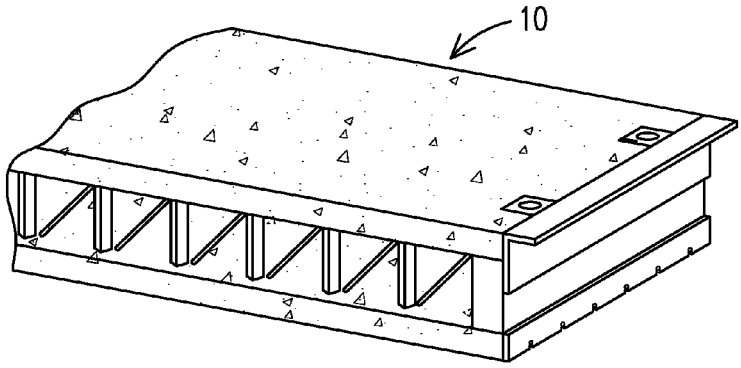
FIG. 10 is a partial perspective view of a finished dual panel composite truss.
Figure 3:
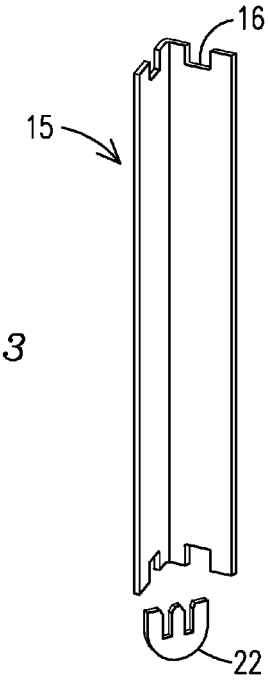
FIG. 3 is an exploded perspective view of a post truss frame member and standoff post.
Figure 2:
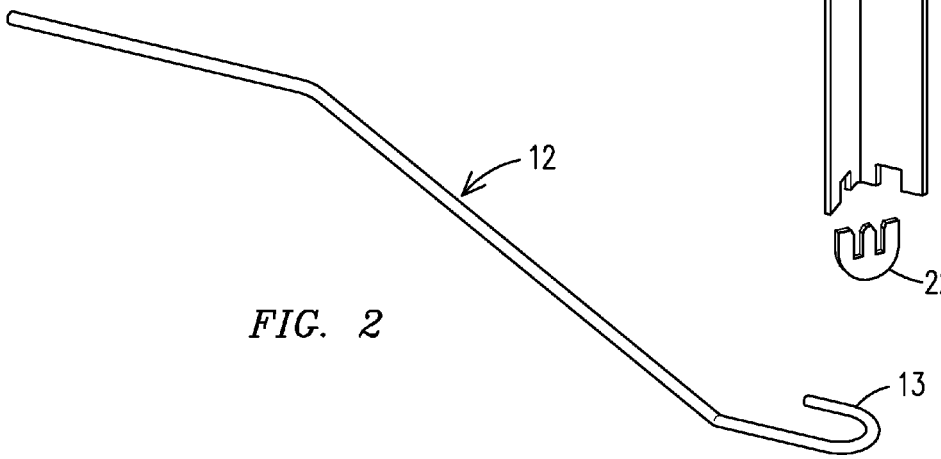
FIG. 2 is a perspective view of a Z-bar bent rod truss frame member.
Figure 5:
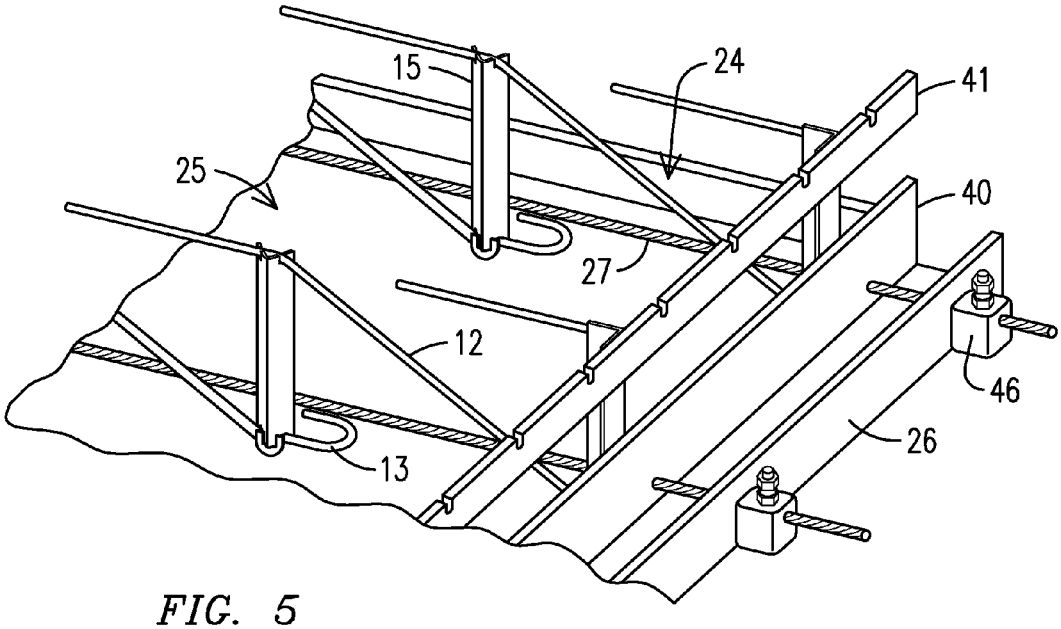
FIG. 5 is a partial perspective view of an assembled truss frame placed in a concrete panel form having prestressed strands therein.
Figure 6:
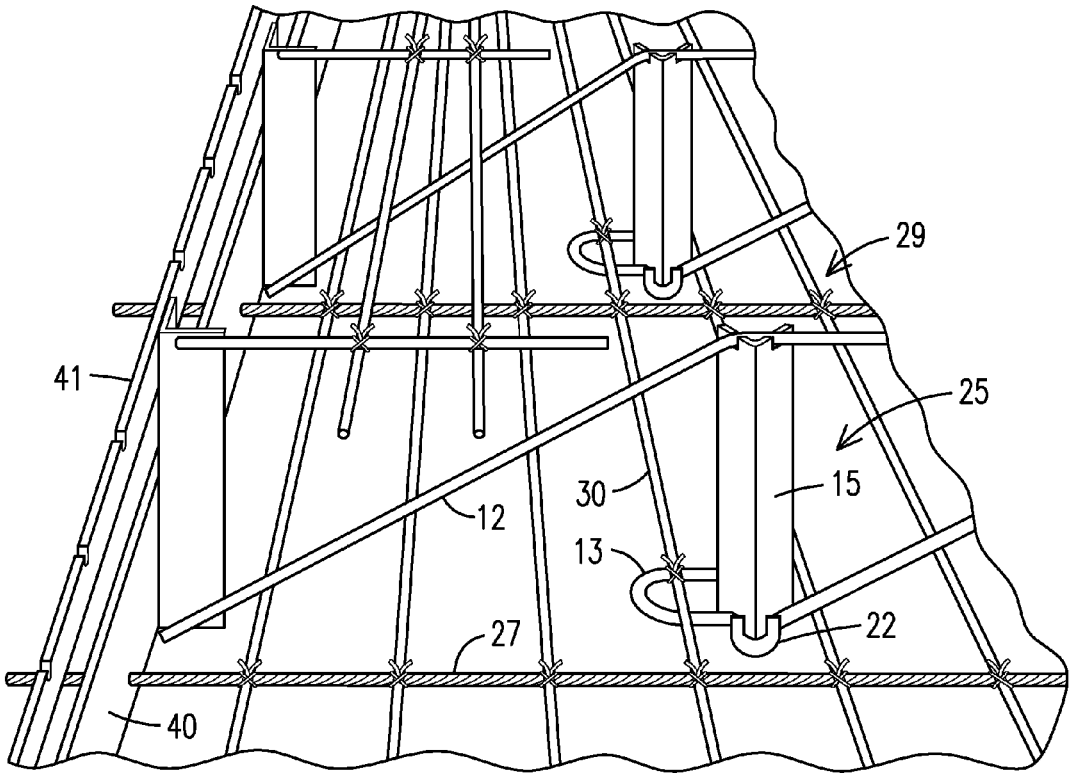
FIG. 6 is a partial perspective view of an assembled truss frame having reinforcing rods and end plates attached thereto.
Figure 7:
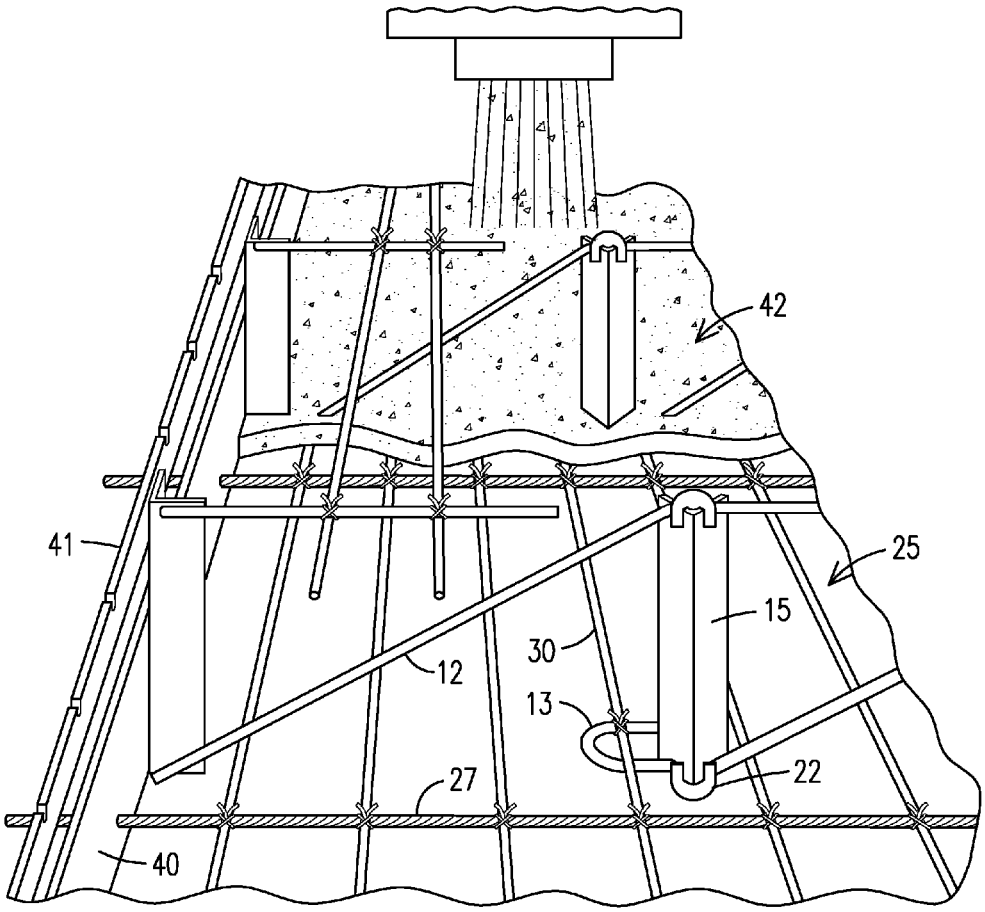
FIG. 7 is a partial perspective view of the pouring of concrete to form a first prestressed concrete panel.

This invention is for a process of forming a dual panel composite truss 10, illustrated generally in FIG. 10, such as may be seen in our prior U.S. patent application Ser. No. 13/826,425 for a Dual Panel Composite Truss Apparatus. The method of making a dual panel composite truss 10 may be seen in the accompanying drawings FIGS. 1 through 9 by following the flow diagram of FIG. 1. The steps in the process of assembling a truss frame including forming a plurality of generally bent rod truss frame members (11) to form a generally Z-shaped truss frame member 12 having a hook-like end 13, sometimes herein referred to Z-bars 12, to a shape as seen in FIG. 2. As seen in FIG. 2, each Z-bar 12 has a hooked end portion 13. A plurality of truss frame posts 15 are formed (14), as seen in FIG. 3, which posts may be angle iron members cut to a predetermined length and having a pair of slots 16 formed in each end thereof. The slots 16 may be punched into each end of the posts 15. A standoff member 22 as seen in FIG. 3 is then selected and attached (18) to each end of each post 15 as seen in FIGS. 5, 6, and 7. A standoff member 22 may be a plastic member shaped as shown to fit into the slots 16 of the posts 15 to stand the post 15 and one side of the assembled truss frame off the form base.

Figure 4:
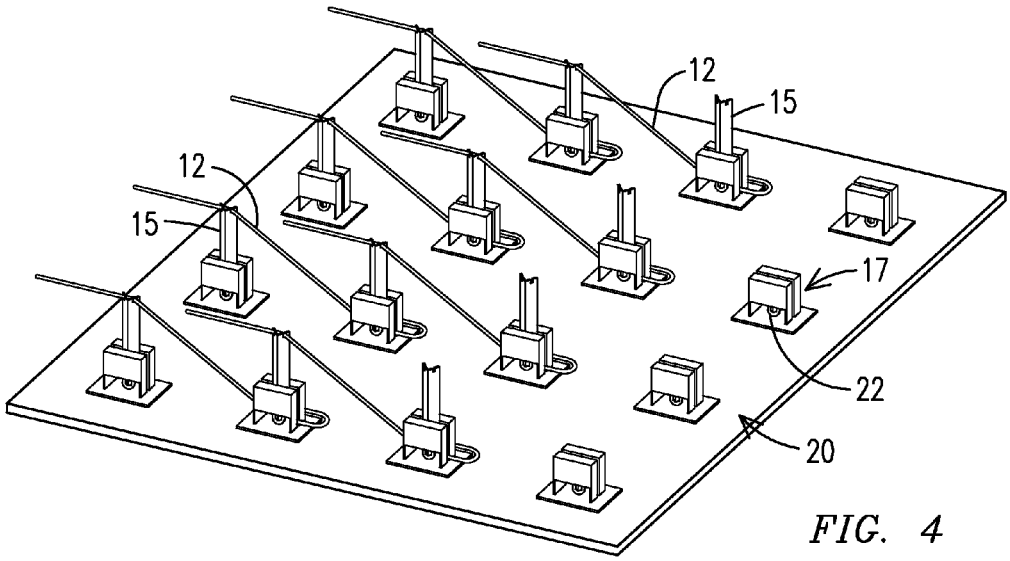
FIG. 4 is a perspective view of a fixture table having a plurality of fixtures aligned thereon and having post and bent truss frame members attached.

A plurality of clamping fixtures 17, as seen in FIG. 4, are selected and laser aligned (21) on an assembly or fixture table 20. The clamping fixtures 17 can be seen in FIG. 4 aligned on the fixture table 20 with each fixture having clamping jaws for clamping a post 15 and Z-bar 12 thereto. A post 15 and Z-bar 12 are attached (23) to each fixture on the fixture table 20. All of the fixtures in FIG. 4 are shown having posts 15 mounted thereto while only part of the fixtures have the Z-bars 12 mounted thereto and thus illustrates a partial assembly in the figure. Each Z-bar 12 can be seen mounted to one end of one post 15 and to the other end of an adjacent post. The fixtures 17 are aligned with a laser alignment system to assure precise alignment. The fixtures 17 are seen holding the Z-bars 12 and posts 15 in exact alignment. As seen in FIGS. 5 and 6, one Z-bar bent rod truss member 12 is attached in a slot at one end of each angle iron post 15 and extends diagonally to the other end of an adjacent post to form a "triangle" assembly and each "triangle assembly" of angle iron post 15 and attached Z-bar 12 is placed into one fixture 17 on the jig fixture table 20. The attached Z-bar 12 of each assembly is then pressed into a slot in the opposite end of an adjacent post 15 slot 16. It should be clear that the number and placement of truss members are determined by detailed structural engineering calculations.

The standoff member 22 maintains the reinforcing elements of the truss frame 29 for one panel in a position to be within the concrete pour for the panel and thus forms the reinforcing for the panel. Rebar 30 is attached to the truss frame to make the truss frame more rigid for moving and more efficient. The truss frame 29 when fully assembled is lifted and has one side placed within the concrete panel form 24 already having prestressed steel strands 27 therein.

Prestressing headers 26 are attached to panel form 24 and the strands tensioning in the form 24 and held under tension by the strain clamps 46 as seen in FIG. 5. End plates 40 and 41 are then attached to each end of the truss frame 29 and may be welded to the end posts 15. The rebar 30 in the truss is attached to the prestress strands. The end plates 40 and 41 will also act as the end walls for each concrete panel concrete pour and become a part of the finished composite truss. End plate 40 will act as the end wall for the concrete pour of the first panel while end plate 41 will act as the end wall for the concrete pour of the second concrete panel when the truss frame is turned over in the form for pouring the second concrete panel.

The steel strands 27 are set in the panel form 24 and threaded through the end plate 40 for the first panel pour and through end plate 41 for pouring the second panel. The strands have been placed in the form 24 for each panel and pass through the header 26 and tensioned (28). The prestressed steel strands 27 are tensioned (28) and held within the frame truss as seen in FIG. 5. The strands 27 are threaded through the headers 26 and tensioned within the form 24 to form a prestressed concrete panel in the form. The tensioned strands are held under tension in the frame by clamps 46 and have the truss frame rebar 30 attached thereto.

The assembled truss frame is lifted and placed in the panel form 24 with the standoffs 22 resting on the form base 25 for making the first of the panel concrete pours into the form 24. Concrete 42 is then poured (33) into the form 24 as seen in FIG. 7 and, when cured, forms one prestressed concrete panel of the dual panel composite truss.

After the truss frame 29 has one side positioned in the concrete panel form 24, the steel reinforcing rods or rebar 30 attached in the truss frame are then attached (31), as seen in FIGS. 6 and 7. The rebar 30 attached to the truss frame may then be attached to the prestressed strands 27 in the form and provides additional reinforcement to the panel once the concrete has been poured and cured to form each panel. End plates 40 and 41 are attached (32) to the ends of the assembled truss frame 29 to add strength to the ends of the truss frame and also act as the end walls for the concrete pour.

Figure 8:
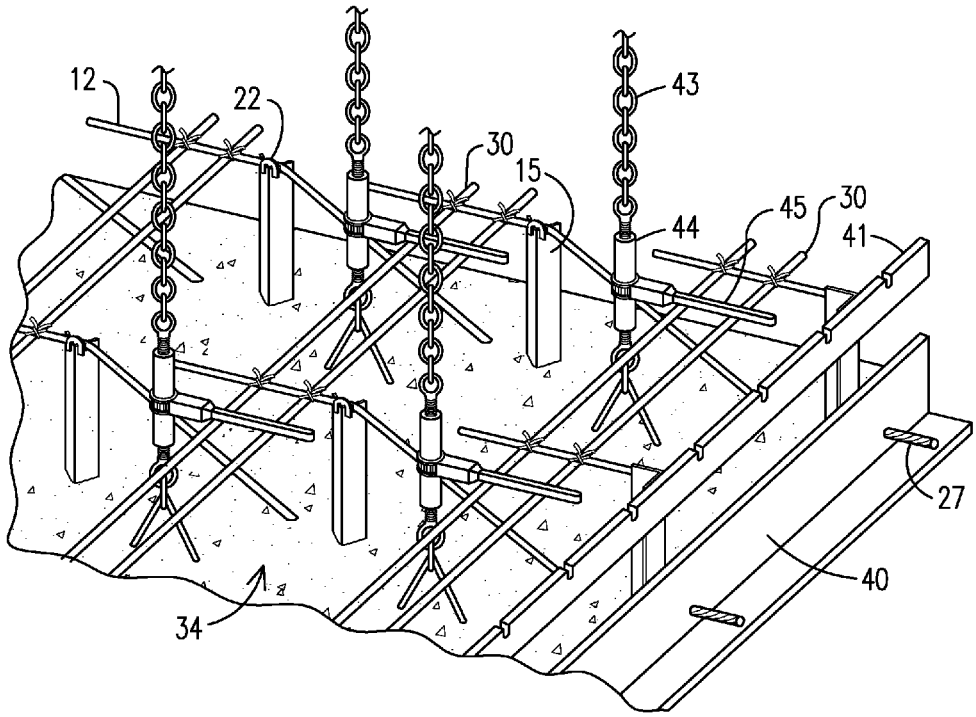
FIG. 8 is a partial perspective view of the truss frame having the first panel formed thereon being stripped and lifted for placing onto a turn table.
Figure 9:
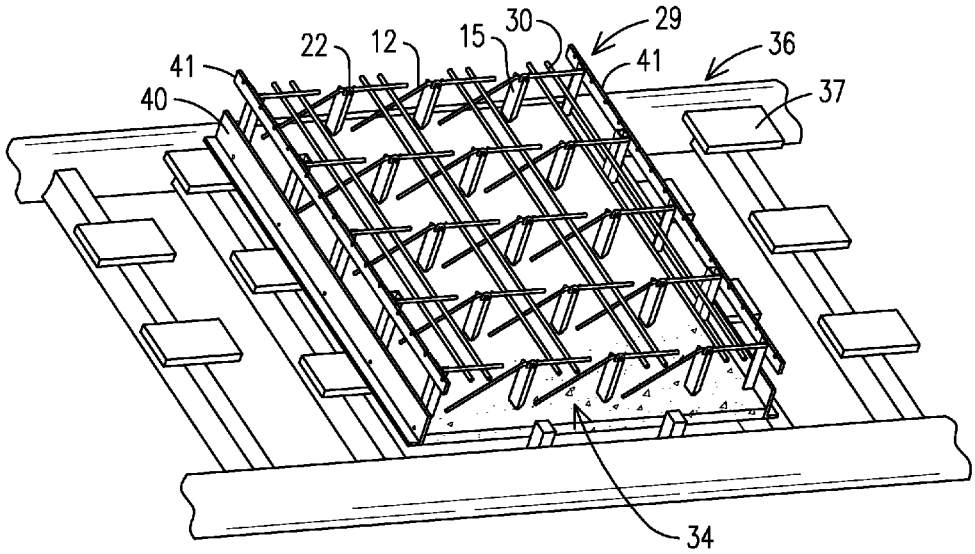
FIG. 9 is a partial perspective view of the truss frame and first panel attached to the turn table and being turned for positioning the other side of the truss frame in the concrete panel form for pouring the second concrete panel.

The truss frame having the one prestressed panel 34 on one side thereof is then lifted with a plurality of lifting chains 43, each having an individual tensioning mechanism, such as a turnbuckle 44, therein as seen in FIG. 8. The chains are lifted by a winch. The chains 43 must be precisely adjusted using the turnbuckles 44 to assure an even lifting to avoid fracturing the first concrete panel. Each turnbuckle 44 has a wrench 45 to tighten or loosen the chains 43. The first concrete panel attached to the truss frame is stripped from the form 24, lifted and transferred (39) to the turn table 36 as seen in FIG. 9. The first panel 34 and truss frame is then turned over (35) or rotated to place the other side of the truss frame into the panel form as seen in FIG. 9. The lifting and turning of the truss frame and one panel 34 is accomplished with a lifting and turning table 36 which has a plurality of vacuum plates 37 thereon which grip the one side of the first panel for holding the panel thereto while lifting and turning the panel and truss frame 34. This requires a large vacuum and numerous vacuum plates due to the great weight of the concrete panel and truss frame.

Once the truss frame and first prestressed concrete panel 34 formed on one side of the truss frame has been rotated and the other side of the truss frame 29 placed within the panel form, a second concrete pour can take place. Pouring and curing the concrete (38) for the second panel completes the forming of a dual panel composite truss 10, as shown generally in FIG. 10, having a pair of spaced parallel prestressed panels spaced by a truss frame having each side thereof molded into a concrete panel and acting as part of the reinforcing of each panel.

It should be clear at this time that a process for making a dual panel composite truss having a pair of spaced apart prestressed concrete panels has been provided. However the present invention is not to be considered limited to the forms shown which are to be considered illustrative rather than restrictive.

We claim:

1. A process of forming a dual panel composite truss comprising the steps of:

assembling a truss frame on a fixture table having a plurality of truss frame clamping fixtures aligned thereon, and including the steps of forming a plurality of posts of predetermined length, each post having two end portions and forming a plurality of bent rod truss members each having two end portions and clamping each post to one said clamping fixture and attaching one end of each bent rod truss member to one end of one said clamped post and attaching the other end to the other end of an adjacent clamped post and attaching a plurality of reinforcing rods to said bent rod truss members;

tensioning a plurality of pre-stressing strands in a concrete panel form;

positioning said assembled truss frame in said concrete panel form having one side resting on the base thereof;

attaching an end plate to each end of the assembled truss frame;

filling said concrete panel form with concrete;

curing the concrete in said panel form between said ends plates to form a first concrete panel on one side of said assembled truss frame;

selecting a turntable having a plurality of vacuum grippers for releasably gripping said first concrete panel attached to one side of said assembled truss frame;

lifting and placing said assembled truss frame and first concrete panel formed on one side thereof onto said turntable;

releasably attaching said first concrete panel having said assembled truss frame attached thereto to said turntable with said plurality of vacuum grippers;

turning said turntable and attached concrete panel and assembled truss frame to position the other side of said assembled truss frame in said panel form;

filling said concrete panel form with concrete; and curing the concrete in said concrete panel form to form a second concrete panel on the other side of said assembled truss frame, spaced from said first concrete panel by said assembled truss frame thereby forming a dual panel composite truss.

2. The process of forming a dual panel composite truss in accordance with claim 1 including the step of making a plurality of post standoff members and attaching one said standoff member to each end of each post to support said assembled truss frame on the base of said panel form.

3. The process of forming a dual panel composite truss in accordance with claim 2 in which the step of forming a plurality of posts includes forming a plurality of posts having a pair of slots on each end thereof.

4. The process of forming a dual panel composite truss in accordance with claim 3 in which each end plate forms the end side for the concrete pour when said assembled truss frame is positioned in said concrete panel form and has each end plate attached thereto.

5. The process of forming a dual panel composite truss in accordance with claim 1 including the step of stripping the panel form from the panel and lifting and placing said first panel onto said turn table.

6. The process of forming a dual panel composite truss in accordance with claim 1 including the step of laser aligning said plurality of truss frame fixtures on said fixture table.

7. The process of forming a dual panel composite truss in accordance with claim 6 including the step of clamping one said post and one said bent rod truss member in each said truss frame fixture on said fixture table.

8. A process of forming a dual panel composite truss comprising the steps of:

assembling a truss frame including the steps of:

bending a plurality of bars into bent truss members;

making a plurality of posts of predetermined length, each post having at least one slot in each end thereof;

making a plurality of standoff members, each shaped to fit one end of one post and attaching one said standoff member to each end of each said post;

selecting a truss frame assembly table;

selecting and positioning a plurality of clamping fixtures onto said truss frame assembly table;

laser aligning said plurality of clamping fixtures on said truss frame assembly table;

attaching one said post to one said clamping fixture on said truss frame assembly table;

attaching one end of each said bent truss member to one end of one said post and the other end of each said bent truss member to the other end of an adjacent post on said truss frame assembly table;

attaching a plurality of reinforcing rods to said plurality of bent truss members to complete an assembled truss frame on said truss frame assembly table;

tensioning a plurality of prestress strands in a concrete panel form;

positioning said assembled truss frame in a concrete panel form having said plurality of tensioned prestressed strands therein;

attaching said plurality of reinforcing rods to said prestress strands;

attaching an end member to each end of the assembled truss frame in the said concrete panel form;

filling said concrete panel form with concrete;

curing the concrete in said concrete panel form to form a first concrete panel on one side of said assembled truss frame between the end plates thereon;

lifting and placing said assembled truss frame and first concrete panel onto a turn table;

turning said assembled truss frame and first panel over to position the other side of said assembled truss frame in said concrete panel form;

filling said concrete panel form with concrete; and curing the concrete in said concrete panel form to form a second concrete panel on the other side of said assembled truss frame, spaced from said first concrete panel to thereby form a dual panel composite truss.

9. The process of forming a dual panel composite truss in accordance with claim 8 in which the step of forming a plurality of posts includes forming a plurality of posts having a pair of slots on each end thereof.

10. The process of forming a dual panel composite truss in accordance with claim 9 in which each concrete form end member forms the one end side of the concrete panel form to limit the end of the concrete pour for the panel.

11. The process of forming a dual panel composite truss in accordance with claim 8 including the step of stripping said first concrete panel and lifting and placing said stripped concrete panel onto a turning table.

12. The process of forming a dual panel composite truss in accordance with claim 11 including the step of gripping and turning said concrete panel and attached truss frame and positioning the truss frame in a concrete panel form.

13. The process of forming a dual panel composite truss in accordance with claim 12 in which the step of gripping said first concrete panel includes vacuum gripping said first panel.

* * * * *